US007581364B2

(12) United States Patent
Godby

(10) Patent No.: US 7,581,364 B2
(45) Date of Patent: Sep. 1, 2009

(54) CLIP FOR ATTACHING SIDING

(76) Inventor: Jerry R. Godby, 216 S. 8th St., Watseka, IL (US) 60970

( * ) Notice: Subject to any disclaimer, the term of this patent is extended or adjusted under 35 U.S.C. 154(b) by 660 days.

(21) Appl. No.: 10/996,623

(22) Filed: Nov. 24, 2004

(65) Prior Publication Data

US 2006/0117694 A1 Jun. 8, 2006

(51) Int. Cl.
*E04D 1/34* (2006.01)
*E04D 1/00* (2006.01)

(52) U.S. Cl. ..... 52/543; 52/545; 52/546; 52/520

(58) Field of Classification Search ..... 52/520, 52/551, 543–546
See application file for complete search history.

(56) References Cited

U.S. PATENT DOCUMENTS

| | | | | | |
|---|---|---|---|---|---|
| 2,126,676 | A | * | 8/1938 | Thomas | 52/520 |
| 3,226,901 | A | * | 1/1966 | Harter | 52/520 |
| 3,418,777 | A | * | 12/1968 | Gillis | 52/520 |
| 3,738,076 | A | * | 6/1973 | Kessler | 52/547 |
| 3,824,756 | A | * | 7/1974 | Kessler | 52/546 |
| 3,992,845 | A | * | 11/1976 | Grzesiek et al. | 52/547 |
| 4,047,349 | A | * | 9/1977 | Aguilar, Jr. | 52/551 |
| 4,295,316 | A | * | 10/1981 | Carlson | 52/588.1 |
| 4,435,933 | A | * | 3/1984 | Krowl | 52/309.1 |
| 4,435,938 | A | * | 3/1984 | Rutkowski et al. | 52/521 |
| 4,782,638 | A | * | 11/1988 | Hovind | 52/547 |
| 5,150,555 | A | * | 9/1992 | Wood | 52/544 |
| 5,339,608 | A | * | 8/1994 | Hollis et al. | 52/545 |
| 5,392,579 | A | * | 2/1995 | Champagne | 52/520 |
| 5,622,020 | A | * | 4/1997 | Wood | 52/546 |
| 6,367,220 | B1 | * | 4/2002 | Krause et al. | 52/512 |
| 6,609,342 | B2 | * | 8/2003 | Hikai | 52/506.01 |
| 6,976,342 | B1 | * | 12/2005 | Kowalevich | 52/546 |
| 7,225,592 | B2 | * | 6/2007 | Davis | 52/547 |

* cited by examiner

*Primary Examiner*—Richard E Chilcot, Jr.
*Assistant Examiner*—Andrew J Triggs
(74) *Attorney, Agent, or Firm*—Vangelis Economou

(57) ABSTRACT

An attachment clip for attaching siding to a wall, the siding having an attachment groove, comprising a nail attachment portion including a body having at least one part extending in a plane and having at least a predetermined thickness and a central nail attachment aperture, a siding engagement portion including a tongue configured and oriented for engagement with the siding attachment groove; and a connecting portion for connecting the nail attachment portion to the siding engagement portion, the connecting portion having at least one part extending away from the plane of the body at a first end and being connected to the siding engagement portion at a second end. Preferably the connection portion extends away from the plane defined by the body at an oblique angle, for example, between 120° to 150°, and most preferably about 135°.

15 Claims, 2 Drawing Sheets

CLIP FOR ATTACHING SIDING

BACKGROUND OF THE INVENTION

1. Field of the Invention

This invention relates generally to building siding attachment clips, and more particularly, to attachment clips able to withstand the temperature extremes of weather conditions while permitting the building siding attached by the clips to freely expand and contract and not affect the attachment.

2. Background Art

Attachment of building siding to outer or external walls is required to meet several criteria, among which is the ability to maintain the integrity of the siding attachment, even when experiencing extremes in weather conditions, such as temperature or high winds. Siding for buildings may comprise any of a number of materials, such as aluminum, wood, vinyl, etc., and the expansion and contraction of these materials may often affect the siding attachment or connection by repeated stresses on the attachment mechanism that retains the siding against the wall to which it is attached. Especially in temperate climates, where temperature may range from well below 0° F. to over 100° F., the repeated stress on the attachment mechanism may externally detach one or more attachment means so that it becomes possible for a strong wind to blow off one or more siding strips, thereby risking further damage and requiring repair or replacement of the siding.

Most external walls require attachment mechanisms, e.g., screws, nails, etc., which may be easily inserted, for example, into walls having a wood panel or similar underlayment. However, it has been especially difficult to attach siding to walls made of concrete blocks, bricks, stucco, stone or similar materials, hereinafter referred to as concrete walls. In order to ensure the integrity of the attachment mechanism to concrete walls, it has been general practice to provide a secondary structural framework comprising an easily attachable material, such as wood, to the underlying concrete wall, and then to attach the siding onto the secondary framework. One preferred form of this type of framework, referred to in the siding installation industry as firring, includes attaching or firring a plurality of wood strips, usually 1"×4" in dimension, vertically to the concrete wall at regular intervals, to provide an attachment framework to which the siding is then horizontally attached in overlying layers. To fir all of the external walls of a building in order to provide the framework for siding attachment can become an overly expensive proposition, for example, costing approximately $4,000.00 for a typical residential building.

Although conventional clips, normally used for attaching siding to underlying surfaces made of wood are available, these mechanisms do not provide the integrity to the attachment when applied to a concrete wall. The conventional clips do not take into account the relative differences in expansion characteristics of the concrete wall, when compared to that of the siding, so that stresses develop as a result of the weather extremes described above. Moreover, the design of conventional attachment clips was not considered as suitable for use with concrete walls, and the shape and configuration of such clips cause the clips to come crack or otherwise deform when installing in concrete walls, as to contact the adjacent or overlying strip of siding, which contact adds significantly to the stresses which the attachment mechanism experiences. Especially in hot weather, such contact may even cause the siding itself to deform. What has been found necessary is an attachment clip that is designed specifically for attaching siding to concrete walls that significantly reduces or substantially eliminates stresses on the attachment mechanism, especially those generated by weather extremes.

SUMMARY OF THE INVENTION

Thus, what is described below, and claimed herein is an attachment clip for attaching siding to a wall, the siding having an attachment groove, comprising a nail attachment portion including a body having at least one part extending in a plane and having at least a predetermined thickness and a central nail attachment aperture, a siding engagement portion including a tongue configured and oriented for engagement with the siding attachment groove; and a connecting portion for connecting the nail attachment portion to the siding engagement portion, the connecting portion having at least one part extending away from the plane of the body at a first end and being connected to the siding engagement portion at a second end. Preferably the connection portion extends away from the plane defined by the body at an oblique angle, for example, between 120° to 150°, and most preferably about 135°.

BRIEF DESCRIPTION OF THE DRAWING FIGURES

DETAILED DESCRIPTION OF THE PREFERRED EMBODIMENTS

Figure 1:
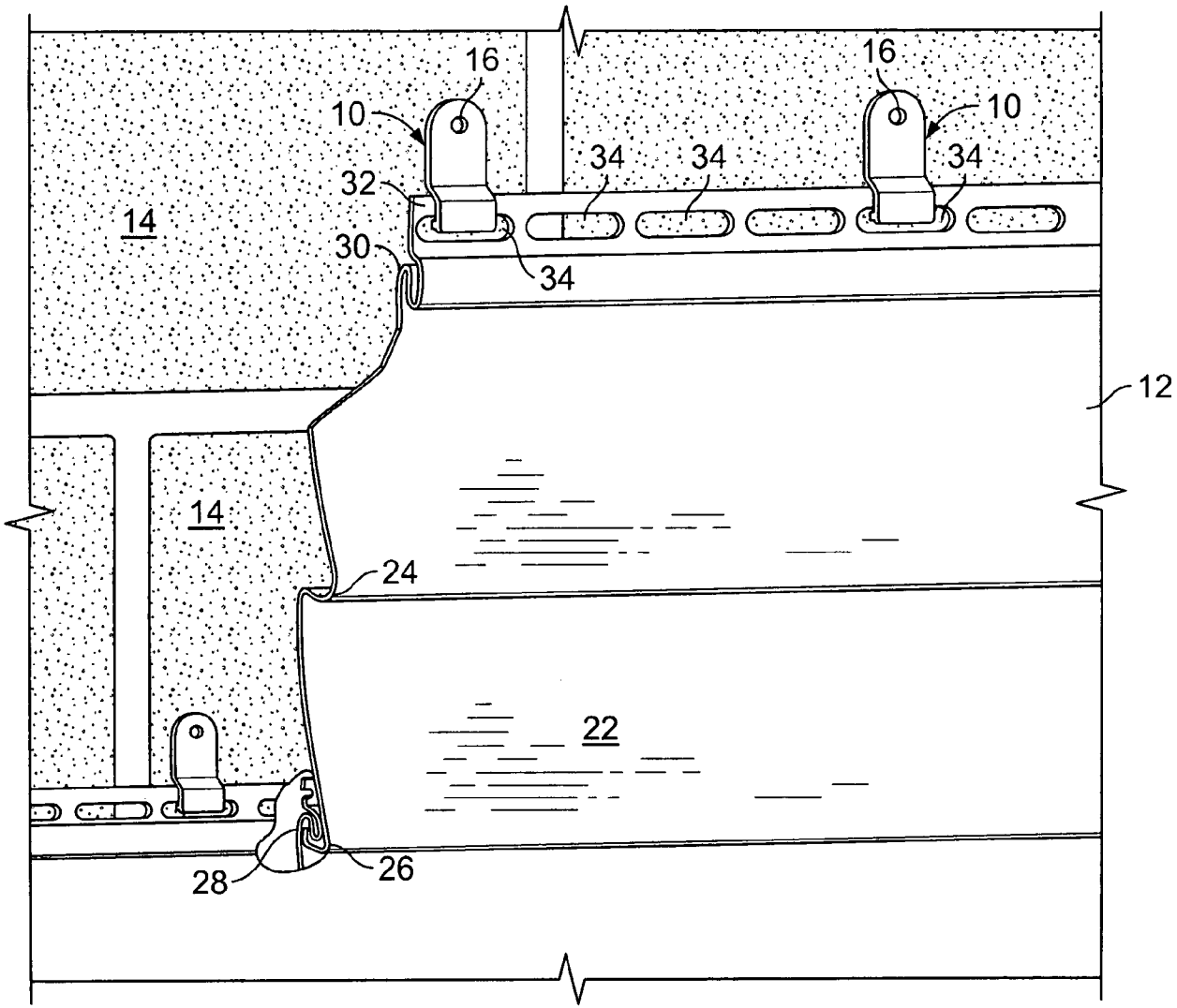
FIG. 1 illustrates in a partially cut-away perspective view clips according to the present invention as used for installing sidings.

Referring now to FIG. 1, the use of the inventive clips 10 is illustrated in the installation of representative siding 12 attached to concrete or cinder blocks 14. The clips are usually attached to the concrete wall by a fastener, such as masonry or concrete nails 16, by an appropriate means, or by use of a ramset gun. However, when high stress methods of attaching the fasteners 16 to the wall are used, e.g., ramset gun, conventional clips have been known to crack or otherwise fail in their intended function, that is, they are unable to retain the siding 12 against the wall as closely as possible to avoid exposure to the elements. Ideally, the clips 10 are configured and oriented such that the siding 12 installed over the previous or underlying strip of siding does not come into contact with the clips 10 retaining the previous strip 12 on the wall.

Most standard siding 12 for installation on walls comprised slats or strips made from wood or other natural materials. More recently, strips of siding 12 have become available that are pre-formed, that is, that have a standard shape and size to facilitate their installation. For example, the siding 12 in FIG. 1 includes the standard features available. These siding strips may comprise aluminum or vinyl, or other plastic materials.

The siding 12 usually comprises an undulating surface 22 which includes a first curve 24, and a second curve 26, disposed below the first curve 24. The second curve terminates in a rim 28, that attaches into a crevice 30 formed in the undulating top portion of the next adjacent siding 12. Thus, the clips 10 hold down one siding strip 12, as shown, but through the attachment between the rim 28 of one strip 12 and the crevice 30 of the adjacent lower strip 12, also retain the ends of both strips 12 against the wall, while only actually coming into physical contact with one of the strip of siding 12.

The undulating upper portion of the siding strip 12 extends upwardly from the crevice 30 to double back and present a flat narrow portion or band 32 that is flush with the surface of the blocks 14, so as to retain the siding immediately adjacent the concrete wall. The narrow band 32 is essentially a flat narrow band having a width much narrower than the width of the strip 12, and includes a series of plural apertures 34 that extend through the material forming the strip 12. The apertures 34 provide the means for attachment of the clips 10 to connect the strip 12 to the blocks 14 on the wall, as will be explained below.

As can be seen from FIG. 1, the first curve 24 mimics the outer surface profile of the second curve 28, so that the strips 12 can take the place of two separate slats that may have been required when using the prior art siding arrangements, for example, wood siding. The materials that are available for the siding strips 12 are also standard, and may include aluminum, vinyl, composites or other appropriate materials. Although standard siding arrangements has been described above, the clips 10 used in attaching the siding 12 to the concrete wall have only been generally described as relating to conventional attachment methods.

The inventive features of the clips 10 will now be described, as well as the advantages and benefits deriving from those features. Specifically, the clips 10 are shaped and configured to provide a tight attachment to the siding, especially of the narrow band 32, to the outer surface of blocks 14. That is, the dimensions of the elements comprising the clip 10 are also predetermined to fit within a standard siding strip 12 and to withstand the impact stresses and strains of installation and attachment of the clip 10 to the blocks, as well as the stresses that result from weather extremes, such as excessive temperature and wind that are experienced in most localities, but especially more recently in temperature zones close to the sea.

The clip 10, in order to withstand expected stresses, comprises a plastic material that has high resistance to deformation or cracking and can maintain its shape and integrity without losing its ability to perform its function. That is, the inventive clip 10 will retain the attachment of the siding 12 to the blocks 14 in all types of conditions, including high winds and repeated fluctuations between excessively high and low temperatures and still maintain its integrity. An especially notable feature of the clips 10 is that the construction and materials tend to avoid nail pull through the nail slot aperture of the clip 10, and because the clip 10 is constructed to be attached with concrete or masonry nails, the nails can also withstand weather extremes without pulling loose from the attachment to the blocks 14.

Figure 2:
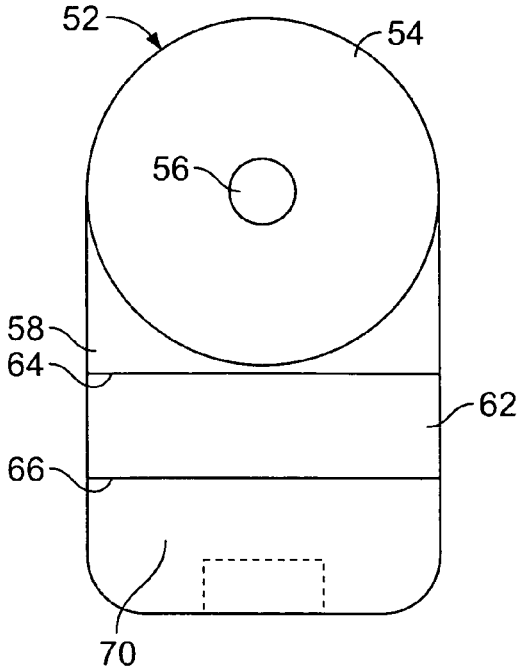
FIG. 2 is a plan view of a first embodiment of the clips according to the present invention.
Figure 3:
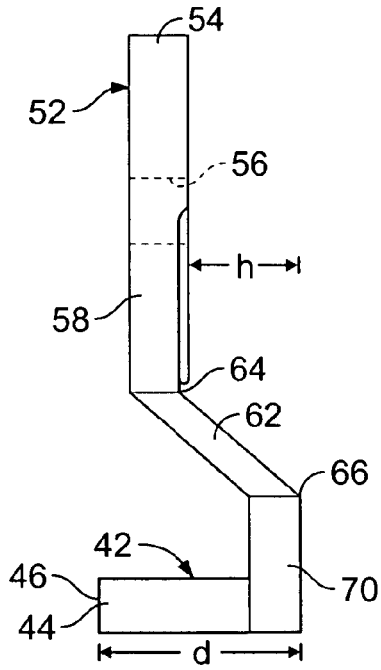
FIG. 3 is a side view of a clip according to a second embodiment of the present invention.

Referring now to FIGS. 2 and 3, a first preferred embodiment of the inventive clip 10 is shown, having three portions, a siding engagement portion 42 for insertion into one of the multiple grooves 34 (FIG. 1) a nail attachment portion 52 and an intermediate connection portion 62, also referred to herein as a nose portion 62, which connects the two section 42, 52 to each other. The siding engagement portion 42 includes a rectangular tongue 44 that engages the edges of one of the grooves 34 so as to fix the retention point of the siding strip 12, and thus to hold the narrow band 32 flush against the concrete blocks 14. Preferably, the dimensions of tongue 44 are suitable for the purpose thereof, that is, thickness large enough to have some ability to retain the siding strip 12 with which it is engaged, but also small enough to fit within the groove 34. For most siding, the width is approximately ⅛", but slight variations in the width may be made, for example, a small tolerance to provide for easier insertion, or a slight amount in excess of the width of the groove, to provide for an interference fit therebetween.

The length dimension of the tongue 44 should be long enough to hold the siding in place, but also not so long as to severely deform the clip 10 when the nail attachment section 52 has been attached to the blocks 14 forming the wall due to the tongue stresses placed on the clip 10. Excessive deformation may result in the tongue 44 being unable to retain the siding 12 against the concrete wall 14.

The nail attachment section 52 preferably also comprises a sturdy and generally circular bead 54, including a concentric, circular aperture 56, for receiving the fastener 16 (FIG. 1) and a transitional tab 58 that connects the circular bead 54 to the connection portion 62, as described below. The bead 54 is shown having a thickness that is larger than the thickness of the transitional tab 58, so that it may be better able to withstand the impact of heavier duty fasteners and methods, for example, a ramset gun or masonry nails pounded in by a heavier duty hammer. These dimensions, however, are only preferred in this embodiment, and other modifications may become evident to a person of ordinary skill in the art. For example, although shown as a circular bead 54 to evenly distribute stresses, the nail attachment portion 52 may be octagonal, rectangular or a square. The nail aperture 56 may also be octagonal (not shown), for example, to better provide an interference fit of the fastener to the bead.

The connecting portion 62 incline with respect to the plane defined by the nail attachment portion 52, and extends from the portion 52 at a predetermined oblique angle defined at a first bend 64. The angle may be between 120° and 150° relative to the surface of portion 52, and is preferably about 135° relative thereto. After it reaches a predetermined height h from the surface of the bead 54, another oblique angle of the same magnitude located at a bend 66 smoothly changes the direction of the connecting 62 to a projection 70 that is essentially parallel to the plane of the bead 54, as shown.

A preferred high impact plastic materials, such as amorphous thermoplastic materials, are well suited to provide the desirable characteristics for manufacture of the clips 10. It has been found that high flow polycarbonate materials are ideally suited for the clips 10, and such materials are available from Bayer Material Science, Klein Chemical Corporation, a subsidiary Division of Bayer Corporation, located in Trenton, N.J. and Whately, Mass., being sold under the names Bayer Polymers Makrolon® 2458 Polycarbonate.

These materials may be injection molded to the desired shape and are able to withstand temperature extremes without excessive shrinkage or deformation.

That is, when the clip 10 is placed upon the concrete wall 14 with the tongue 44 extending through a groove 34 (FIG. 1), the terminal end 46 is flush with the surface of the concrete wall 14. When the nail or other fastener 16 is inserted into the aperture 56 and pounded into the concrete wall 14, the back surface of the bead 54 also will become flush with the concrete wall 14, thereby causing the connection portion 62 between the other two portions 42, 52 to buckle because of the resistance of the wall 14 to any penetration by the terminal end 46. However, because of the natural resiliency of the plastic material comprising clip 10, and especially the connecting portion 62, the nail attachment portion 52 being flush with the concrete wall will continue to exert a transverse force on the tongue 44 to retain the terminal end 46 against the concrete wall 14.

Figure 4:
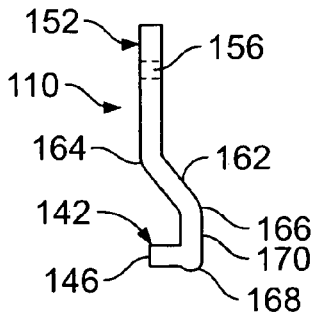
FIG. 4 is a side view of a clip according to a second embodiment of the present invention.
Figure 5:
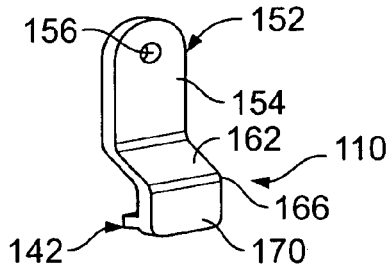
FIG. 5 is a perspective view of the clips shown in FIG. 4.

A second embodiment that includes a number of variants in design relative to the clip 10 is shown in FIGS. 4 and 5. Clip 110 is similar in design to the clip 10, but has variant design elements but which is also considered to be within the scope of the present invention.

Clip 110 also comprises three portions, including a siding engagement portion 142, a nail attachment portion 152 and a transition portion 162, connecting the two portions 142, 152. Subtle differences are evident when comprising the clip 10 with the clip 110. First, the nail attachment section 152 does not have a circular shape, but is semicircular at the top around a central aperture 156, but distinct transitional tab is present, the bead 154 running smoothly together into the first bead 164 of connection section 162, as shown. A second difference exists in the nose extension 168, extending beyond the attachment of the siding strip engagement portion 142 to the flat downwardly extending projection 170. Yet another design variant lies in the width of the rearwardly extending tongue 144, which is shown in the perspective view of FIG. 5 to have a width equal to the width of the projection 170, in contrast to the tongue 42 of the clip 10, which only has a width that is significantly smaller than that of the corresponding projection 70. Also, the distal end 146 of tongue 144 is in the same plane as the back surface of the nail attachment portion 132, as shown. Of course, the salient features of the invention are still present, for example, the flat nail attachment portion 142 having a thickened bead to provide added integrity, and so as to absorb the impact of heavy duty fasteners, as described above. Also, the angle of the connecting portion 162 and the total depth of the siding strip engagement section 142 have the characteristics described above.

Other modifications, alterations or variants may be utilized by those having ordinary skill, for example, by utilizing some other material or shape, or for use with other building materials, as described above, to retain the siding against the wall or to provide for more automated installation, without departing from the scope of the present invention. Although the above description has been directed mostly toward the use of the inventive clip for attaching siding to concrete or cinder block walls, it is possible to use these types of clips in building having wood or other conventional materials, which can be utilized in extreme conditions. For example, the clip can be used on wood installations in areas that are subject to frequent high winds, e.g., the areas of the Mexican Gulf during hurricane season. Modification, for example using a screw to connect the inventive clip to a wood wall, may be required, so as to enable conventional wood installations to withstand the high winds experienced in such areas. Accordingly, the above embodiments are to be considered as being illustrative only, the invention being limited only by the following claims.

What is claimed is:

1. An attachment clip for attaching siding to a wall, the siding being formed as individual strips and having an attachment aperture at an upper siding edge, comprising:

a) a nail attachment portion including a body having a back surface and at least one part extending in a plane configured to come into contact with the wall and further having at least a predetermined thickness and a central nail attachment aperture;

b) a siding engagement portion including a tongue, including a distal tongue end configured and oriented for engagement with the siding attachment aperture, the distal tongue end extending essentially perpendicularly to the plane of the body; and c) a connecting portion for connecting the nail attachment portion to the siding engagement portion, the connecting portion having at least one part extending away from the plane of the body at a first end and being connected to the siding engagement portion at a second end, the second end being removed from the distal tongue end, wherein the distal tongue end extends essentially perpendicularly from the second end of the connecting portion toward the plane of the body, and the attachment clip is shaped and configured, following attachment, to retain only one strip of siding by attaching only the upper edge of each strip of siding, including the attachment aperture, against the wall, and wherein the tongue extends to a position beyond the plane defined by the back surface of the body to provide flexure of the connecting portion such that it will continue to exert a transverse force on the tongue to retain a terminal end thereof against the wall after the nail attachment portion is flush with the wall.

2. The clip attachment according to claim 1 in which the connection portion extends away from the plane defined by the body at an oblique angle.

3. The clip attachment according to claim 2 wherein the oblique angle is in a range of from 120° to 150°.

4. The clip attachment according to claim 3 wherein the oblique angle is approximately 135°.

5. The clip attachment according to claim 1 wherein the connection portion includes a first part that is attached to and extends from the nail attachment portion and a second part that is essentially parallel to the body and extending from the first part at one end thereof and being attached to the siding engagement portion adjacent another end thereof.

6. The clip attachment according to claim 5 wherein the siding engagement portion extends toward the plane defined by the body in a direction essentially perpendicular to that plane.

7. The clip attachment according to claim 6 wherein the side engagement portion further comprises the tongue for engagement with the siding groove, and the tongue has a lateral width of approximately one-half of the width of the connecting portion.

8. The clip attachment according to claim 1 wherein height h between the plane of the body at the first end and the siding engagement portion second end is less than the height of a curved section of the siding in an outwardly projecting direction.

9. The clip attachment according to claim 1 wherein height h between the siding engagement portion relative to the central nail attachment aperture upper surface is less than the height of a curved section of the siding in an outwardly projecting direction.

10. An attachment clip for attaching siding to a wall, the siding having an attachment strip and at least one siding attachment aperture extending through the attachment strip, the attachment clip comprising:

a) a nail attachment portion including a body having at least one part extending in a plane defining a back surface located distally from a connecting portion and having at least a predetermined thickness and a central nail attachment aperture;

b) a siding engagement portion including a tongue, the tongue extending essentially perpendicularly to the plane of the nail attachment body beyond the plane of the back surface of the body and being configured and oriented for insertion into and passing through the siding attachment aperture; and c) a connecting portion for connecting the nail attachment portion to the siding engagement portion, the connecting portion having a width and at least one part extending away from the plane of the body at a first end and being connected to the siding engagement portion at a second end, wherein the tongue extends essentially perpendicularly from the second end of the connecting portion toward the plane of the body, so that the shape and configuration of the siding engagement portion causes the insertion of the tongue of the siding engagement portion into the attachment strip aperture of the siding attachment strip when the plane of the nail attachment portion is brought into congruence with the siding such that, following attachment and insertion of the tongue end into the attachment strip aperture, the tongue end is in contact with the wall to which the siding is being attached and flexure of the connecting portion continues to exert a transverse force on the tongue to retain a terminal end thereof against the wall after the nail attachment portion is flush with the wall, the siding engagement portion thereby retaining only one strip of siding by attaching only the attachment strip of a single siding against the wall.

11. The clip attachment according to claim 10 in which the connection portion extends away from the plane defined by the body at an oblique angle.

12. The clip attachment according to claim 11 wherein the oblique angle is approximately 135°.

13. The clip attachment according to claim 10 wherein the tongue has a lateral width of approximately one-half of the width of the connecting portion.

14. The clip attachment according to claim 10 wherein height h between the plane of the body at the first end and the siding engagement portion second end is less than the height of a curved section of the siding in an outwardly projecting direction.

15. The clip attachment according to claim 10 wherein height h between the siding engagement portion relative to the central nail attachment aperture upper surface is less than the height of a curved section of the siding in an outwardly projecting direction.

* * * * *